US005763146A

United States Patent [19]

Reynolds et al.

[11] Patent Number: 5,763,146

[45] Date of Patent: Jun. 9, 1998

[54] PHOTOGRAPHIC MATERIALS CONTAINING WATER SOLUBLE AMINO HEXOSE REDUCTONES

[75] Inventors: James H. Reynolds; Steven P. Szatynski; Jeffrey L. Hall, all of Rochester; Norma B. Platt, Webster, all of N.Y.

[73] Assignee: Eastman Kodak Company, Rochester, N.Y.

[21] Appl. No.: 814,517

[22] Filed: Mar. 10, 1997

Related U.S. Application Data

[63] Continuation-in-part of Ser. No. 757,368, Nov. 27, 1996, abandoned.

[51] Int. Cl.[6] ..... G03C 7/46

[52] U.S. Cl. ..... 430/377; 430/448; 430/486; 430/567; 430/566; 430/564; 430/434; 430/442; 430/462

[58] Field of Search ..... 430/448, 486, 430/567, 566, 564, 434, 442, 462, 377

[56] References Cited

U.S. PATENT DOCUMENTS

| | | | |
|---|---|---|---|
| 2,936,308 | 5/1960 | Hodge | 430/483 |
| 3,667,956 | 6/1972 | Mitsuto et al. | 430/553 |
| 3,672,896 | 6/1972 | Gabirelsen et al. | 430/448 |
| 3,690,872 | 9/1972 | Gabrielsen et al. | 430/448 |
| 3,695,888 | 10/1972 | Hiller et al. | 430/567 |
| 3,700,442 | 10/1972 | Gabrielsen et al. | 430/564 |
| 3,816,137 | 6/1974 | Gabrielsen et al. | 430/566 |

FOREIGN PATENT DOCUMENTS 335 107 10/1989 European Pat. Off. .

OTHER PUBLICATIONS

Research Disclosure 37038, Feb. 1995, pp. 79–115.

*Primary Examiner*—Geraldine Letscher
*Attorney, Agent, or Firm*—Paul A. Leipold

[57] ABSTRACT

The invention relates to a silver halide photographic emulsion comprising silver halide grains and the reductone of Formula I

I wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring such as aziridinyl, azetidinyl, pyrrolidinyl, piperidinyl, morpholinyl, piperazinyl, or pyridinyl, $R_4$ and $R_5$ are H, OH, alkyl, aryl, cycloalkyl, or may together represent an alkylidene group, n is 1 or 2 and $R_3$ is H, alkyl, aryl, or $CO_2R_6$ where $R_6$ is alkyl, and
wherein the logarithm of the partition coefficient for the reductone when equilibrated as a solute between n-octanol and water (logP) is less than 0.293.

33 Claims, No Drawings

PHOTOGRAPHIC MATERIALS CONTAINING WATER SOLUBLE AMINO HEXOSE REDUCTONES

CROSS REFERENCE TO RELATED APPLICATIONS

This is a continuation-in-part of application Ser. No. 08/757,368 filed Nov.27, 1996 now abandoned, entitled PHOTOGRAPHIC MATERIALS CONTAINING WATER SOLUBLE AMINO HEXOSE REDUCTONES by James H. Reynolds et al.

FIELD OF THE INVENTION

This invention relates to photographic materials comprising water soluble amino hexose reductones.

BACKGROUND OF THE INVENTION

This invention relates to silver halide photographic materials with improved raw-stock and latent image keeping properties. Piperidino hexose reductone (PHR) (2-,5-Dihydroxy-5-methyl-3-{1-piperidinyl}-2-cyclo-penten -1-one), R-1) is known in the art as an addendum for photographic materials, as described for example in *Research Disclosure*, Item 37038 of February 1995. The use of PHR in the finish of thin tabular grains is described by D. Daubendiek in copending coassigned U.S. Ser. No. 08/595,679 filed Feb. 2, 1996. Reducing agents in general have been previously disclosed as addenda for silver chloride emulsion applications (EP 335,107). PHR has also been disclosed in combination with spectral sensitizing dyes (U.S. Pat. No. 3,695,888), and reductones are also discussed in U.S. Pat. No. 2,936,308 and U.S. Pat. No. 3,667,958.

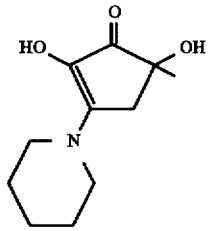

(R-1)

(Piperidino hexose reductone, PHR)

However, PHR suffers from a number of significant drawbacks that make it unattractive in a manufacturing environment for photographic materials. Chief among these is its limited water solubility, which carries several negative consequences. First, large volumes of PHR solution must be prepared, stored, transported, and delivered to the coating operations used in the manufacture of photographic products. Second, the large volume of water from the PHR solution must be managed in the formulation of the photographic material that contains the PHR. Third, this large volume of water from the PHR solution must be removed during the drying operation to obtain the desired photographic element. These constraints in the volume of water that is used in the design of the photographic material may result in less than optimal levels of the PHR being incorporated, simply because the formulation cannot accomodate larger amounts of the PHR solution.

A fourth consequence of the poor water solubility of PHR is the storage stability of the resulting solutions. The PHR concentration starts to drop immediately after the solution is prepared, and PHR solutions have very short lifetimes. This brief shelf life adversely affects solution inventory management, and carries both cost and environmental burdens because expired doctored solutions must be disposed of properly. We have investigated the mechanism of PHR decomposition in aqueous solution, and have determined that the instability arises from oxidation of the PHR anion by dissolved oxygen. This reaction is exacerbated by the low solubility of PHR. While PHR solutions can also be stabilized by preparing them with nitrogen-purged water, the utility of this practice at a manufacturing scale is in question.

PROBLEM TO BE SOLVED BY THE INVENTION

Thus, there is an urgent need for more water soluble reductones that overcome the deficiencies of PHR, but that simultaneously retain or improve upon the desirable raw-stock and latent image keeping properties of PHR.

SUMMARY OF THE INVENTION

An object of the invention is to overcome disadvantages of prior keeping addenda.

A further object is to provide reductones that are more soluble than previous reductones.

Another object of the invention is to provide photographic products with improved raw stock and latent image keeping properties.

These and other advantages are generally accomplished by providing a silver halide photographic emulsion comprising silver halide grains and the reductone of Formula I

I

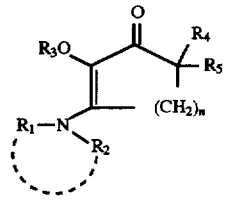

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring such as aziridinyl, azetidinyl, pyrrolidinyl, piperidinyl, morpholinyl, piperazinyl, or pyridinyl, $R_4$ and $R_5$ are H, OH, alkyl, aryl, cycloalkyl, or may together represent an alkylidene group, n is 1 or 2, and $R_3$ is H, alkyl, aryl, or $CO_2R_6$ where $R_6$ is alkyl wherein the logarithm of the partition coefficient for the reductone when equilibrated as a solute between n-octanol and water (logP) is less than 0.293.

In a preferred form of the invention there is provided a photographic element comprising a silver halide photographic emulsion comprising silver halide grains and the reductone of Formula I

I

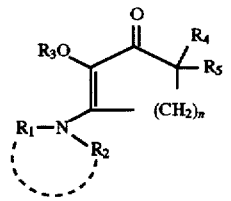

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring such as aziridinyl, azetidinyl, pyrrolidinyl, piperidinyl,.morpholinyl, piperazinyl, or pyridinyl, $R_4$ and $R_5$ are H, OH, alkyl, aryl, cycloalkyl, or may together represent an alkylidene group, n is 1 or 2, and $R_3$ is H, alkyl, aryl, or $CO_2R_6$ where $R_6$ is alkyl wherein the logarithm of the partition coefficient for the reductone when equilibrated as a solute between n-octanol and water (logP) is less than 0.293.

ADVANTAGEOUS EFFECT OF THE INVENTION

The invention has the advantage that the invention reductones provide improved raw stock and latent image keeping of photographic materials. The invention reductones also are more easily and effectively added to photographic materials during their manufacture.

DETAILED DESCRIPTION OF THE INVENTION

The invention has numerous advantages over prior materials and processes for improving latent image and raw stock keeping. The invention material is easy to add to the photographic system prior to laydown of the photographic elements. The reductones of the invention form stable aqueous systems that may be easily stored and transported without deterioration of their properties and effectiveness in the photographic system. The reductones of the invention are low in cost as they are easily prepared and stable in storage. The reductones of the invention also do not have a deleterious effect on the image properties of the photographic elements in which they are utilized. The invention reductones as they are highly water soluble do not add significant water to the photographic system which would need to be removed during drying or would limit the water used for the preparation of the other components of the photographic elements.

The reductones of the invention can be represented by the following generic structure:

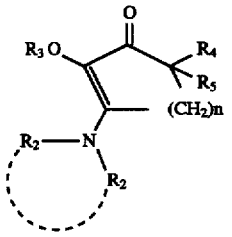

wherein $R_1$ and $R_2$ are the same or different, and may represent H, alkyl, cycloalkyl, aryl, or an alkyl group with a solubilizing group such as —OH, sulfonamide, sulfamoyl, or carbamoyl. Alternatively, —$R_1$ and $R_2$ may be joined to complete a heterocylic ring such as aziridinyl, azetidinyl, pyrrolidinyl, piperidinyl, morpholinyl, piperazinyl, or pyridinyl, $R_4$ and $R_5$ are H, OH, alkyl, aryl, cycloalkyl, or may together constitute an alkylidene group, n is 1 or 2, and $R_3$ is H, alkyl, aryl, or $CO_2R_6$ where $R_6$ is alkyl.

The logarithm of the partition coefficient for the reductone when equilibrated as a solute between n-octanol and water (logP) is less than 0.293.

In one preferred embodiment, $R_1$ and $R_2$ complete a morpholino ring, $R_3$ is hydrogen, $R_4$ is —OH, $R_5$ is methyl, and n is 1. In another preferred embodiment, $R_1$ and $R_2$ are methyl, $R_3$ is hydrogen, $R_4$ is —OH, $R_5$ is methyl, and n is 1. These structures are represented by R-2 and R-3 of preferred invention compounds R-2 to R-17 below.

R-2

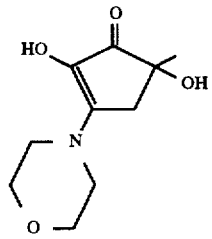

R-3

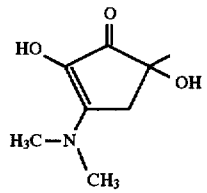

R-4

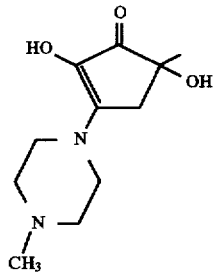

R-5

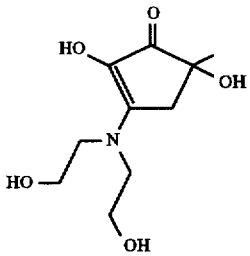

R-6

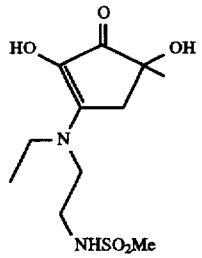

R-7

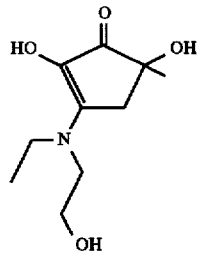

-continued

R-8

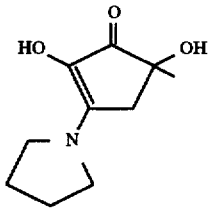

R-9

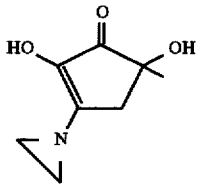

R-10

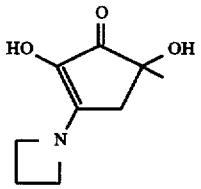

R-11

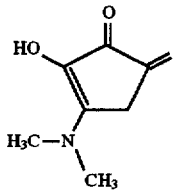

R-12

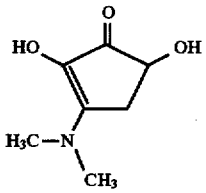

R-13

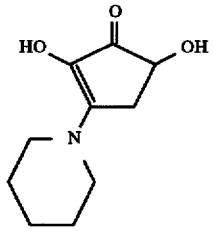

R-14

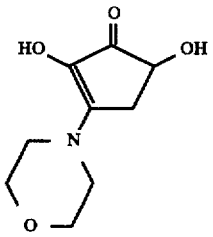

-continued

R-15

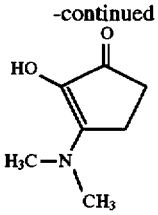

R-16

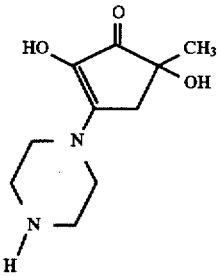

and

R-17

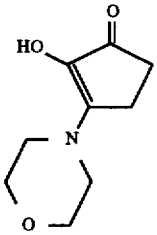

The reductone of the invention may be utilized in any amount that is effective to improve latent image keeping and raw stock keeping. Generally an amount between about 0.002 and 200 μm mol/m$^2$ is suitable. A preferred amount has been found to be between about 10 and 100 μm mol/m$^2$ to provide the most effective and economical improvement in raw stock keeping while maintaining speed and low fog.

The reductones used in the invention can be prepared by the acid catalyzed condensation of D-glucose with amines, for example, as described in U.S. Pat. No. 2,936,308. The reductones can be prepared directly, or they may be obtained from the intermediate glycosylamines by heating.

The partition coefficient suitably is less than 0.293. However, it has been found that a preferred partition coefficient for the reductone when it equilibrated as a solute between n-octanol and water (logp) is between 0.293 and −1.0 for good solubility and raw stock keeping improvement.

The reductone of the invention may be added to any layer in the photographic element. The reductone tends to move between the layers during formation of the photographic element and, therefore, the layer of addition is less critical. It has been found satisfactory to add the reductone to the yellow coupler dispersion utilized in the blue sensitive layer. The reductone may suitably be added to the coupler dispersion or to the emulsion prior to coating. Further, it may be added immediately prior to coating of the layers of the photographic element. A preferred place of addition has been found to be into the coupler dispersion prior to its being combined with the silver halide grains of the emulsion, as this provides a latent image keeping improvement with minimal effect on speed of the silver halide grains.

The photographic elements formed by the invention may utilize conventional peptizing materials and be formed on conventional base materials such as polyester and paper. Further, other various conventional plasticizers, antifoggants, brighteners, bacterialcides, hardeners and coating aids may be utilized. Such conventional materials are found in *Research Disclosure*, Item 308119 of December, 1989 and *Research Disclosure*, Item 38957 of September 1996.

The photographic elements formed by the invention may also contain other materials that are used to modify the characteristics of the silver halide emulsions. The silver halide emulsions can be chemically sensitized with active gelatin as illustrated by T. H. James, *The Theory of the Photographic Process*, 4th Ed., Macmillan, 1977, pp. 67–76, or with sulfur, selenium, tellurium, gold, a platinum metal (platinum, palladium, rhodium, ruthenium, iridium and osmium), phosphorus sensitizers, or combinations of these sensitizers. Examples of other addenda that may be used include N-(2-benzoxazolyl)propargylamines, as described by Lok et al in U.S. Pats. Nos. 4,4378,426 and 4,451,557.

A preferred color photographic element according to this invention comprises a support bearing at least one blue-sensitive silver halide emulsion layer having associated therewith a yellow dye-forming coupler, at least one green-sensitive silver halide emulsion layer having associated therewith a magenta dye-forming coupler and at least one red-sensitive silver halide emulsion layer having associated therewith a cyan dye-forming coupler, at least one of the silver halide emulsions layers containing a latent image stabilizing compound of this invention. In accordance with a particularly preferred aspect of the present invention, the invention compound is contained in a yellow dye-forming blue-sensitive silver emulsion.

The elements of the present invention can contain additional layers conventional in photographic elements, such as overcoat layers, spacer layers, filter layers, antihalation layers, scavenger layers, and the like. The support can be any suitable support used- with photographic elements. Typical supports include polymeric films, paper (including polymer-coated paper), glass, and the like. Details regarding supports and other layers of the photographic elements suitable for this invention are contained in *Research Disclosure*, Item 17643, December 1978, and *Research Disclosure*, Item 38957 of September 1996.

The reductones of the invention may be suitably utilized in color paper products. It may suitably be utilized with a variety of grains, vehicles, sensitizing dyes, and other materials utilized in formation of color paper. Further, it may be utilized in the layered coatings such as illustrated in *Research Disclosure*, Item 37038 of February 1995.

The following examples illustrate the practice of this invention. They are not intended to be exhaustive of all possible variations of the invention. Parts and percentages are by weight unless otherwise indicated.

EXAMPLES

One useful criteria for establishing relative water solubilities is logP, where P is the partition coefficient for a solute equilibrated between n-octanol and water. A material with a more negative logP is thus more water soluble. Table 1 lists logp values for amino hexose reductones, calculated using the computational algorithm MedChem (version 3.54). Also listed in Table 1 is a solubility criterion, in which a reductone is regarded as soluble if it fully dissolved in a fixed volume of water. The data show that compounds of the invention are more water soluble than the comparison, PHR.

TABLE 1

| Compound | C LogP[a] | Water Soluble?[b] |
|---|---|---|
| R-1 (Comparison) | 0.293 | No |
| R-2 (Invention) | −1.165 | Yes |
| R-3 (Invention) | −0.809 | Yes |
| R-4 (Invention) | −0.541 | Yes |

[a]Log P Estimated with MedChem v. 3.54.
[b]Compound considered soluble if 50 mg completely dissolves in 10 ml water at 25° C.

As a further demonstration of the enhanced solubility of these reductones, the following experiment was conducted. Two grams of compounds R-1, R-2, and R-3 were placed in separate 100 ml volumetric flasks, and distilled water was added to the mark. The solutions were sonicated for ten minutes, after which time they were filtered through pre-weighed filter funnels equipped with a medium glass frit. The funnels and their contents were then dried and re-weighed. The difference in mass before and after filtering thus represents the amount of undissolved reductone; and the smaller this difference the more soluble the material. The results in Table 2 show that more than 93% of the comparative example remained insoluble and was retained by the funnel, while no material from the inventive compounds was undissolved.

TABLE 2

| Compound | Mass of Funnel | Mass of Funnel + Contents after Filtering | Mass of insoluble Reductone |
|---|---|---|---|
| R-1 (Comparison) | 36.60 g | 38.46 g | 1.86 g |
| R-2 (Invention) | 37.36 g | 37.36 g | 0.00 g |
| R-3 (Invention) | 40.12 g | 40.13 g | 0.01 g |

Solution Stability

An example of the improved solution stability of the water soluble reductones is shown in Table 3. Saturated solutions of the compounds were prepared with distilled water. The storage stability was then determined by measuring the UV absorbance of the solutions at 310 nm following 3 days and 19 days at room temperature, and comparing it with the absorbance of the fresh solutions. The fraction of original absorbance following storage is expressed in Table 3 as a percentage. As is readily apparent, the compounds of the invention exhibit much greater solution stability than the comparison.

TABLE 3

Storage stability of Reductone Solutions

| Compound | % Remaining 3 days | % Remaining 19 days |
|---|---|---|
| R-1 (Comparison) | 83.1 | 25.4 |
| R-2 (Invention) | 97.7 | 87.3 |
| R-3 (Invention) | 99.4 | 88.6 |

Photographic Testing

A multilayer color negative film element was used to test the ability of the water soluble reductones to improve the storage stability of blue-sensitized emulsions. The following structures were used in the multilayer examples:

DYE-1
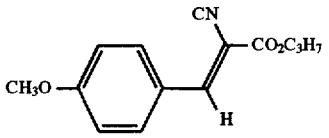
DYE-2
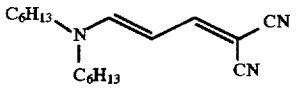
DYE-3
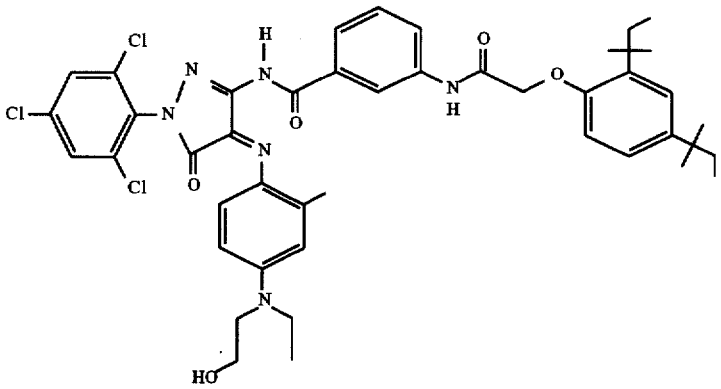
DYE-4
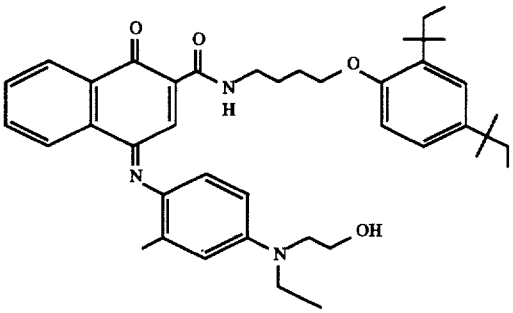
OxDS-1
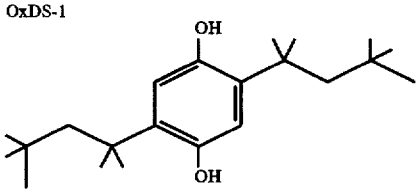
MC-1
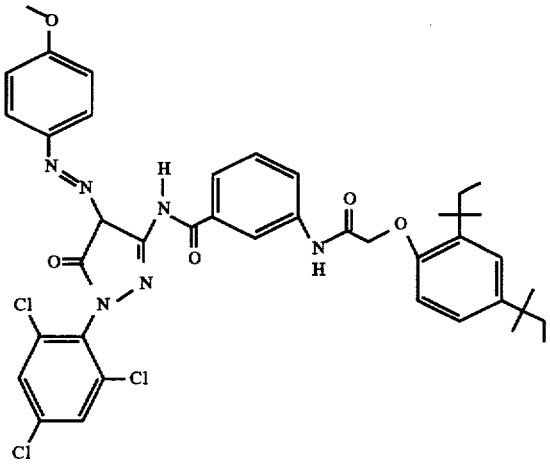
B-1
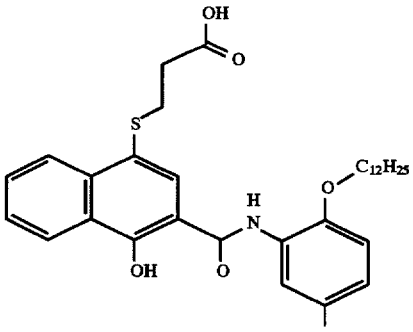

-continued
C-1
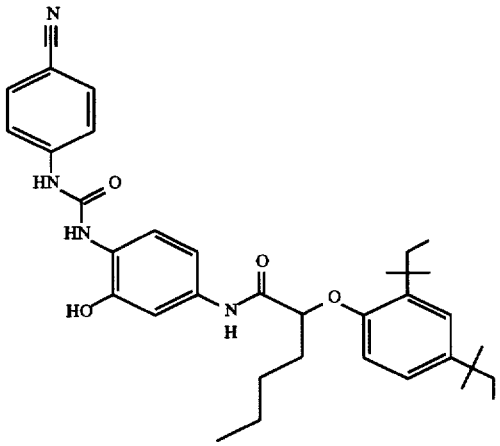
DIR-1
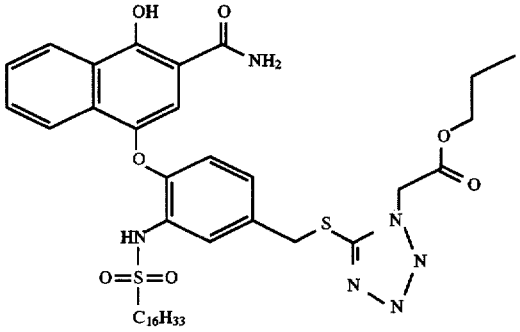
DIR-2
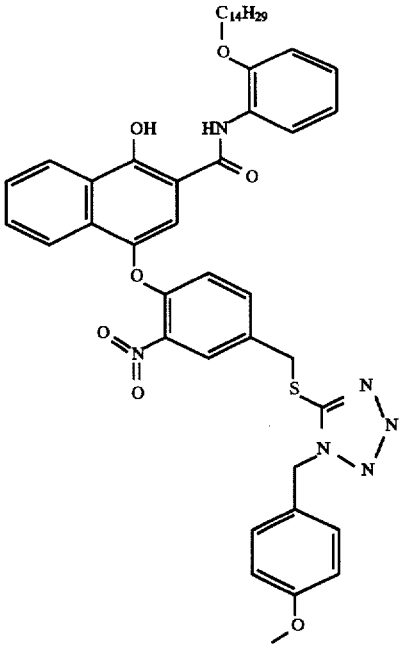
MC-2
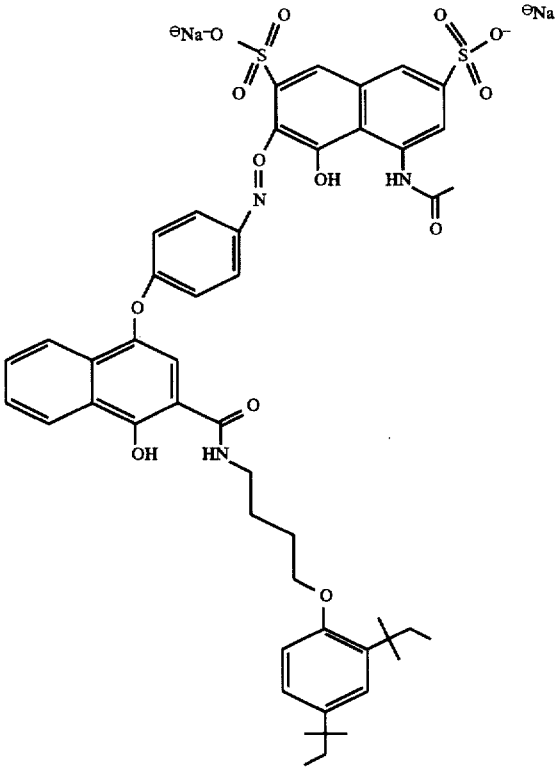

-continued
YFD-1
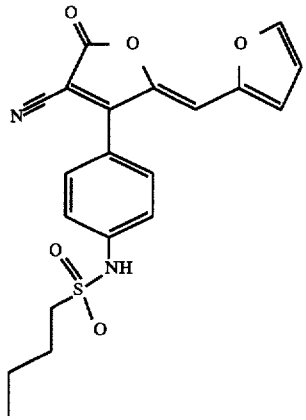
DIR-3
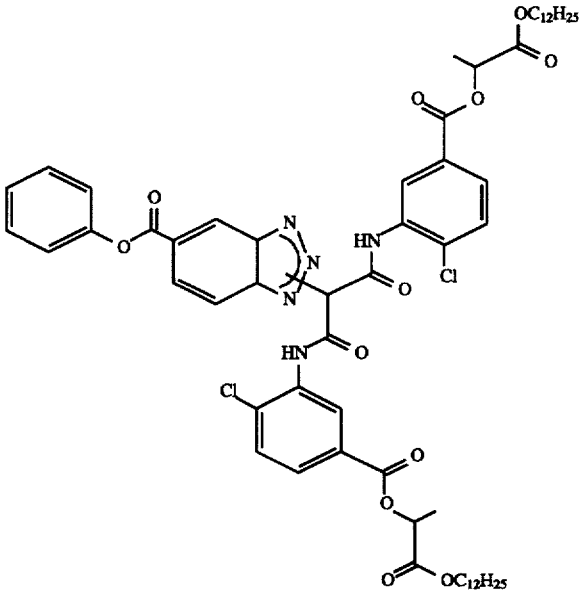
MC-3
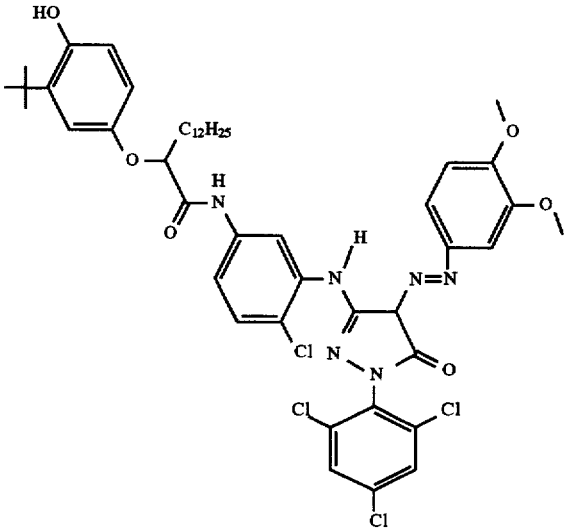
DIR-4
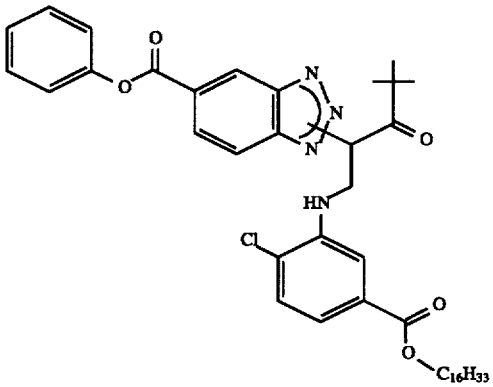

-continued

M-1

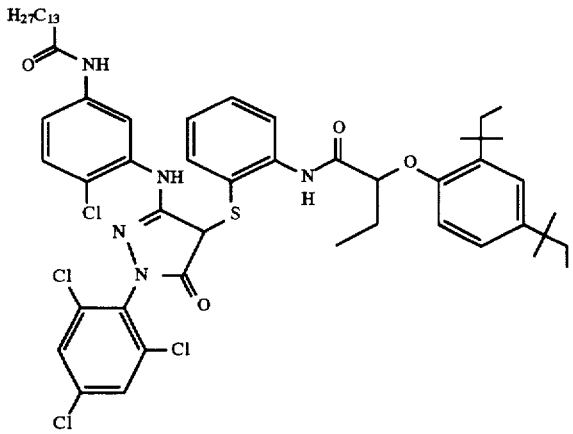

Y-1

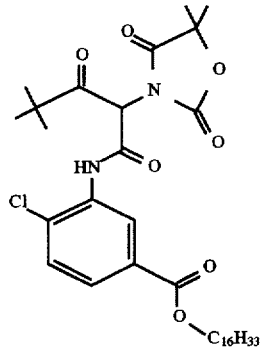

The multilayer color negative film elements were constructed using the following layer order:

Support

Layer 1 (AHU, Antihalation U-coat)
Layer 2 (Slow cyan imaging layer)
Layer 3 (Mid cyan imaging layer)
Layer 4 (Fast cyan imaging layer)
Layer 5 (Interlayer)
Layer 6 (Slow magenta imaging layer)
Layer 7 (Mid magenta imaging layer)
Layer 8 (Fast magenta imaging layer)
Layer 9 (Yellow filter layer)
Layer 10 (Yellow imaging layer)
Layer 11 (Ultraviolet protection layer)
Layer 12 (Protective overcoat)

The general composition of the multilayer coatings follows. The examples cited herin specify changes made in layer 10. Layers 1 through 9 and layers 11 and 12 are common throughout for the described multilayer coatings.

| Layer | Amount | Component |
|---|---|---|
| Layer 1: | 2045 mg/dm$^2$ | Gelatin |
| | 134.5 | Gray Silver |
| | 30.1 | UV Absorber dye (DYE-1) |
| | 45.2 | UV Absorber (DYE-2) |
| | 21.5 | Magenta dye (DYE-3) |
| | 26.9 | Cyan dye (DYE-4) |
| | 0.032 | Yellow-colored magenta coupler (MC-1) |
| | 0.14 | Oxidized developer scavenger (OxDS-1) |
| Layer 2 | 1679 mg/m$^2$ | Gelatin |
| | 775 | Slow cyan silver |
| | 532.8 | Cyan dye former (C-1) |
| | 26.9 | Cyan image modifier (DIR-2) |
| | 56.5 | Cyan bleach accelerator (B-1) |
| | 32.3 | Magenta-colored cyan coupler (MC-2) |
| Layer 3 | 1076 mg/m$^2$ | Gelatin |
| | 430.5 | Mid cyan silver |
| | 180.8 | Cyan dye former (C-1) |
| | 19.4 | Cyan image modifier (DIR-2) |
| | 8.1 | Cyan bleach accelerator (B-1) |
| | 32.3 | Magenta-colored cyan coupler (MC-2) |
| Layer 4 | 914.9 mg/m$^2$ | Gelatin |
| | 592.0 | Fast cyan silver |
| | 209.9 | Cyan dye former (C-1) |
| | 26.9 | Cyan image modifier (DIR-2) |
| | 21.5 | Magenta-colored cyan coupler (MC-2) |
| Layer 5 | 538 | Gelatin |

-continued

| Layer | Amount | Component |
|---|---|---|
| | 86.1 | Oxidized developer scavenger (OxDS-1) |
| Layer 6 | 1076 mg/m$^2$ | Gelatin |
| | 430.5 | Slow magenta silver |
| | 279.9 | Magenta dye former (M-1) |
| | 86.1 | Yellow-colored magenta coupler (MC-3) |
| | 10.7 | Yellow image modifier (DIR-3) |
| Layer 7 | 699.7 | Gelatin |
| | 538.2 mg/m$^2$ | Mid magenta silver |
| | 96.9 | Magenta dye former (M-1) |
| | 118.4 | Yellow-colored magenta coupler (MC-3) |
| | 43.1 | Yellow image modifier (DIR-3) |
| Layer 8 | 699.7 mg/m$^2$ | Gelatin |
| | 538.2 | Fast magenta silver |
| | 70.0 | Magenta dye former (M-1) |
| | 53.8 | Yellow-colored magenta coupler (MC-3) |
| | 3.3 | Cyan bleach accelerator (B-1) |
| | 30.1 | Cyan image modifier (DIR-1) |
| Layer 9 | 645.8 mg/m$^2$ | Gelatin |
| | 86.1 | Oxidized developer scavenger (OxDS-1) |
| | 53.8 | YFD-1 |
| Layer 10 | 528.5 mg/m$^2$ | Gelatin |
| | 1076 | Yellow emulsion T-1 |
| | 807.3 | Yellow dye former-1 |
| | 80.7 | Yellow image modifier DIR-4 |
| Layer 11 | 699.7 mg/m$^2$ | Gelatin |
| | 107.6 | UV absorber dye (DYE-1) |
| | 215.3 | Lippmann silver |
| Layer 12 | 882.6 mg/m$^2$ | Gelatin |
| | 107.6 | Soluble matte beads |
| | Lubricants | |
| | 1.5% Hardener | |

The emulsion T-1 in the 10th layer was a blue-sensitized tabular grain bromoiodide emulsion, and the halide composition of the emulsion was 95.5% silver bromide and 4.5% silver iodide. The emulsion had an equivalent circular diameter of 3 micrometers and a thickness of 0.13 micromenters as measured by a scanning electron microscope. Also incorporated into Layer 10 was a reductone. In a control coating (coating 1), no reductone was present in the multilayer film. In coatings 2 through 9 reductones R-1 through R-4 were incorporated into the film element at levels of 25.5 μmol/m$^2$ and 51.0 μmol/m$^2$.

These coatings were tested for raw-stock keeping in the following manner. Two sets of results were compared. In the control set, strips of coatings were stored for 3 months at 0° F. For the test coatings, a set was incubated for 3 months at 78° F./50% RH. After the 3 months, the coatings from both sets were exposed to white light at 5500K for 0.01 seconds.

The exposed coatings were then developed for 195 sec at 38° C. using the known C-41 color development process as described, for example, in *The British Journal of Photographic Annual* 1988, pp 196–198. The developed silver was removed in the 240 sec bleaching treatment, washed for 180 sec, and the residual silver salts were removed from the coating by a treatment of 240 sec in a fixing bath. The Status M densities of the processed strips were read and used to generated characteristic curves. The speed of the blue-sensitive color record of the coating was determined at a fixed density above the minimum density measured in an unexposed area using the equation:

$$\text{Speed}=100*(1-\text{Log H})$$

where Log H is the exposure that corresponds to 0.15 Status M density units above the minimum density. Speed differences are expressed as $$\text{Delta Speed}=\text{Test}-\text{Reference}$$

Therefore, negative values are associated with test coatings that are slower (of lower speed) than the control coatings. In addition, control coatings and test coating were measured at a density value corresponding to a mid-scale exposure. Density differences are expressed as $$\text{Delta Density}=\text{Test}-\text{Reference}$$

The data obtained from these measurements are provided in Table 4.

TABLE 4

| | | | | Change in Sensitometry After 3 Months 78° F./50% RH Raw Stock Keeping | |
|---|---|---|---|---|---|
| Coating | Compound | Level (μmol/m²) | Fresh Speed | Delta Speed | Delta Mid-scale Density |
| 1 | None | — | 358.9 | −11.0 | −0.057 |
| 2 | R-1 | 25.5 | 357.3 | −5.4 | −0.024 |
| 3 | R-1 | 51.0 | 355.1 | −3.7 | −0.021 |
| 4 | R-2 | 25.5 | 358.5 | −6.7 | −0.027 |
| 5 | R-2 | 51.0 | 356.6 | −6.0 | −0.020 |
| 6 | R-3 | 25.5 | 355.7 | −2.2 | −0.009 |
| 7 | R-3 | 51.0 | 355.0 | −3.0 | −0.008 |
| 8 | R-4 | 25.5 | 356.6 | −4.9 | −0.025 |
| 9 | R-4 | 51.0 | 355.8 | −5.1 | −0.008 |

Thus, not only do these soluble reductones overcome the disadvantges of the prior art, but they are also effective at stabilizing color negative films against changes incurred during storage. The reductones of the invention are effective in maintaining speed of the emulsion while limiting the change in density during storage. They are even somewhat more effective than the prior slightly soluble reductones known in the art.

In a similar manner, the coatings were also tested for stability of the latent image (latent image keeping, or LIK). In the control set, strips of coatings were simply stored for 3 months at 78° F./50% RH. For the test coatings, a set was incubated for 2 months at 78° F./50% RH, exposed as described above, then held for an additional month at 78° F/50% RH. After storage, the control coatings were exposed, and both the control and the test coating sets were processed as described above for the raw-stock keeping example. The difference in speed and blue density between the control and test strips thus represents the stability of the latent image under the storage conditions. The results from these LIK tests are reported in Table 5.

TABLE 5

| | | | | Change in Sensitometry After 1 Month 78° F./50% RH Latent-Image Keeping | |
|---|---|---|---|---|---|
| Coating | Compound | Level (mmol/m²) | Fresh Speed | Speed Loss | Mid-scale Density Loss |
| 1 | None | — | 358.9 | −11.8 | −0.125 |
| 2 | R-1 | 25.5 | 357.3 | −8.6 | −0.054 |
| 3 | R-1 | 51.0 | 355.1 | −7.1 | −0.031 |
| 4 | R-2 | 25.5 | 358.5 | −8.0 | −0.052 |
| 5 | R-2 | 51.0 | 356.6 | −5.8 | −0.041 |
| 6 | R-3 | 25.5 | 355.7 | −5.6 | −0.016 |
| 7 | R-3 | 51.0 | 355.0 | −5.0 | −0.013 |
| 8 | R-4 | 25.5 | 356.6 | −5.9 | −0.023 |
| 9 | R-4 | 51.0 | 355.8 | −3.7 | −0.017 |

As the data in Table 5 show, the soluble reductones are also effective at stabilizing the latent image against changes incurred during storage.

The invention has been described in detail with particular reference to preferred embodiments thereof, but it will be understood that variations and modifications be effected within the spirit and scope of the invention.

We claim:

1. A silver halide photographic emulsion comprising silver halide grains and the reductone of Formula I

I

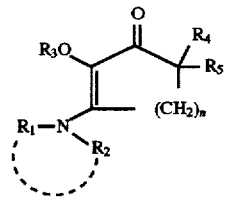

wherein $R_1$ and $R_2$ are the same or different, and may represent H, alkyl, cycloalkyl, aryl, or an alkyl group with a solubilizing group such as —OH, sulfonamide, sulfamoyl, or carbamoyl. $R_1$ and $R_2$ may be joined to complete a heterocyclic ring, $R_4$ and $R_5$ are OH, alkyl, aryl, cycloalkyl, or may together represent an alkylidene group, n is 1 or 2 and $R_3$ is H where $R_6$ is alkyl, and wherein the logarithm of the partition coefficient for the reductone when equilibrated as a solute between n-octanol and water (logP) is less than 0.293.

2. The emulsion of claim 1 wherein said silver halide grains comprise silver bromoiodide grains.

3. The emulsion of claim 2 wherein said silver halide grains are tabular.

4. The emulsion of claim 1 wherein in said reductone of Formula I $R_1$ and $R_2$ complete a morpholino ring.

5. The emulsion of claim 1 wherein in said reductone of Formula I $R_3$ is hydrogen, $R_4$ is —OH, $R_5$ is methyl, and n is 1.

6. The emulsion of claim 1 wherein said reductone of Formula I is selected from the group consisting of

R-2

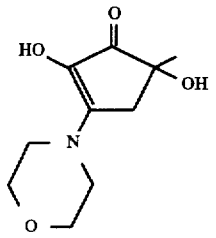

R-3

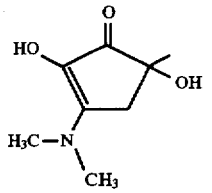

R-4

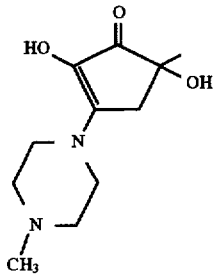

R-5

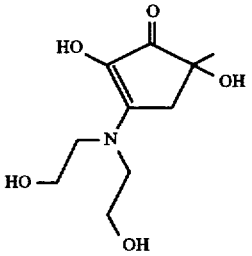

R-6

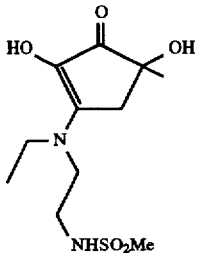

R-7

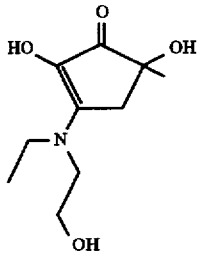

-continued

R-8

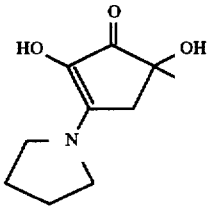

R-9

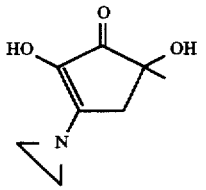

R-10

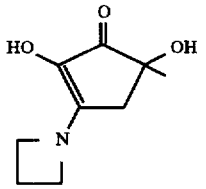

R-11

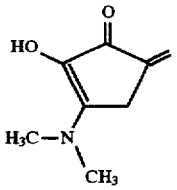

and

R-16

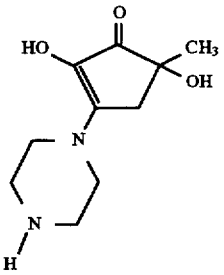

7. The emulsion of claim 1 where said partition coefficient is between 0.293 and −1.0.

8. The emulsion of claim 1 wherein said reductone is present in an amount between about 0.005 and 200 μm mol/m$^2$.

9. The emulsion of claim 1 wherein said reductone is present in a amount between about 10 and 50 μm mol/m$^2$.

10. A photographic element comprising an A silver halide photographic emulsion comprising silver halide grains and the reductone of Formula I

I

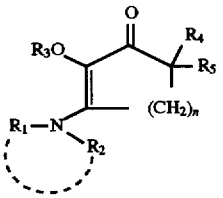

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring, $R_4$ and $R_5$ are OH, alkyl, aryl, cycloalkyl, or may together represent an alkylidene group, n is 1 or 2 and $R_3$ is H where $R_6$ is alkyl, and wherein the logarithm of the partition coefficient for the reductone when equilibrated as a solute between n-octanol and water (logP) is less than 0.293.

11. A photographic element of claim 10 wherein said photographic element comprises a color negative film.

12. A photographic element of claim 10 wherein said compound of Formula I is present in the blue sensitive layer.

13. The photographic element of claim 10 wherein said silver halide grains comprise silver bromoiodide grains.

14. The photographic element of claim 13 wherein said silver halide grains are tabular.

15. The photographic element of claim 10 wherein in said reductone of Formula I $R_1$ and $R_2$ complete a morpholino ring.

16. The photographic element of claim 10 whwerin in said reductone of Formula I $R_3$ is hydrogen, $R_4$ is —OH, $R_5$ is methyl, and n is 1.

17. The photographic element of claim 10 wherein said reductone of Formula I is selected from the group consisting of

R-2

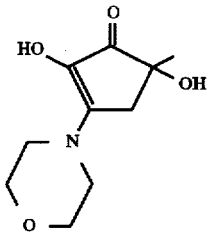

R-3

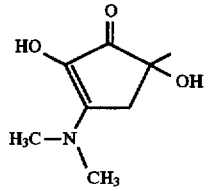

R-4

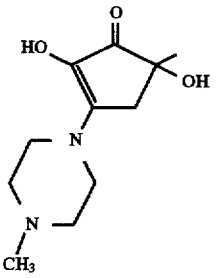

R-5

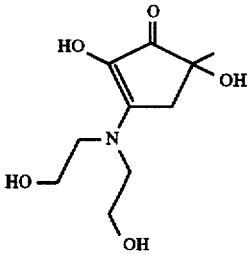

-continued

R-6

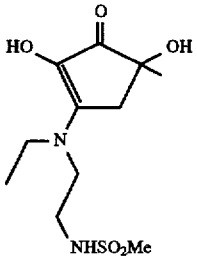

R-7

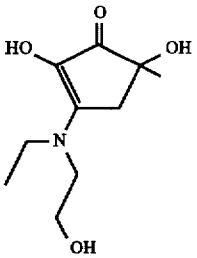

R-8

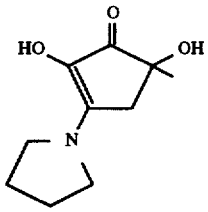

R-9

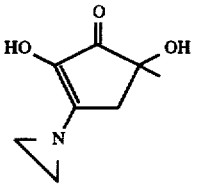

R-10

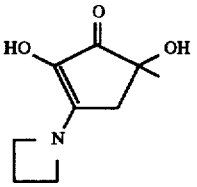

R-11

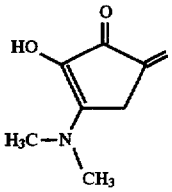

and

R-16

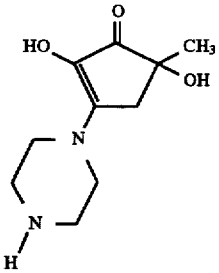

18. The photographic element of claim 10 wherein said partition coefficient is between 0.293 and −1.0.

19. The photographic element of claim 10 wherein said reductone is present in an amount between about 2 and 200 μm mol/m$^2$.

20. The photographic element of claim 10 wherein said reductone is present in an amount between about 10 and 50 μm mol/m$^2$.

21. A method of forming a photographic element comprising providing a dispersion of photographic coupler, providing an emulsion, adding an aqueous solution of reductone of Formula I

I

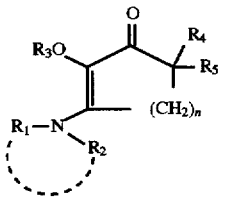

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring, $R_4$ and $R_5$ are OH, alkyl, aryl, cycloalkyl, or may together represent an alkylidene group, n is 1 or 2 and $R_3$ is H where $R_6$ is alkyl, wherein the logarithm of the partition coefficient for the reductone when equilibrated as a solute between n-octanol and water (logP) is less than 0.293, combining said dispersion of photographic coupler containing reductone and said emulsion, coating said combined dispersion and emulsion onto a support material to form a photographic element.

22. The method of claim 21 wherein said silver halide grains comprise silver bromoiodide grains.

23. The method of claim 21 wherein in said reductone of Formula I $R_1$ and $R_2$ complete a morpholino ring.

24. The method of claim 21 wherein in said reductone of Formula I $R_3$ is hydrogen, $R_4$ is —OH, $R_5$ is methyl, and n is 1.

25. The method of claim 21 wherein said reductone of Formula I is selected from the group consisting of

R-2

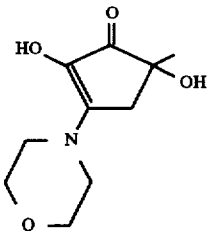

R-3

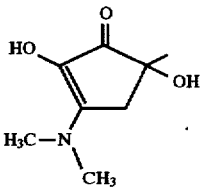

-continued

R-4

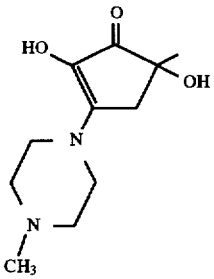

R-5

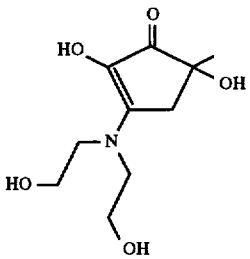

R-6

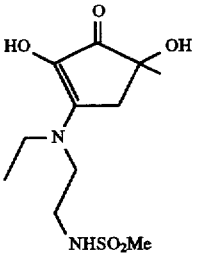

R-7

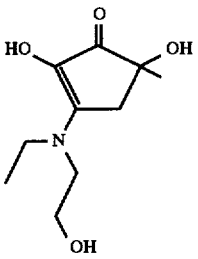

R-8

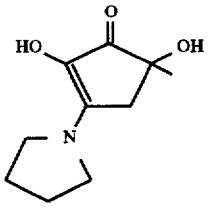

R-9

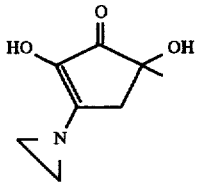

-continued

R-10

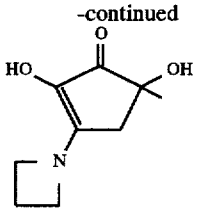

R-11

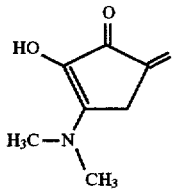

and

R-16

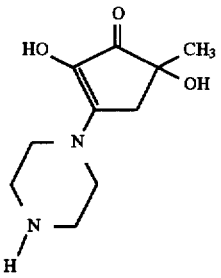

26. The method of claim 21 wherein said partition coefficient is between 0.293 and −1.0.

27. The method of claim 21 wherein said reductone is present in an amount between about 0.005 and 200 μm mol/$m^2$.

28. The method of claim 21 wherein said reductone is present in an amount between about 10 and 50 μm mol/$m^2$.

29. The method of claim 21 wherein said photographic element comprises a color negative film.

30. The method of claim 21 wherein said compound of Formula I is present in the blue sensitive layer.

31. The method of claim 21 wherein $R_1$ and $R_1$ are joined to form a heterocyclic ring selected from the group consisting of aziridinyl, azetidinyl, pyrrolidinyl, piperidinyl, morpholinyl, piperazinyl, and pyridinyl.

32. The element of claim 10 wherein $R_1$ and $R_2$ are joined to form a heterocyclic ring selected from the group consisting of aziridinyl, azetidinyl, pyrrolidinyl, piperidinyl, morpholinyl, piperazinyl, and pyridinyl.

33. The emulsion of claim 1 wherein $R_1$ and $R_2$ are joined to complete a heterocyclic ring selected from the group consisting of aziridinyl, azetidinyl, pyrrolidinyl, piperidinyl, morpholinyl, piperazinyl, and pyridinyl.

* * * * *